United States Patent [19]

Peters, Jr.

[11] 3,998,136

[45] Dec. 21, 1976

[54] HIGH SPEED PARTITION ASSEMBLING METHOD AND APPARATUS

[75] Inventor: Charles L. Peters, Jr., Norco, Calif.

[73] Assignee: Box Innards, Inc., Anaheim, Calif.

[22] Filed: Jan. 19, 1976

[21] Appl. No.: 650,246

[52] U.S. Cl. ..... 93/37 R

[51] Int. Cl.[2] ..... B31B 11/02; B31B 1/00

[58] Field of Search ..... 93/37 R, 36.01, 36.6, 93/1 H, 93 R

[56] References Cited

UNITED STATES PATENTS 3,646,857 3/1972 McDougal ..... 93/37 R

*Primary Examiner*—Robert Louis Spruill
*Assistant Examiner*—Horace M. Culver
*Attorney, Agent, or Firm*—Perry E. Turner

[57] ABSTRACT

Strips with confronting notched edges to be interlocked for forming a multi-cell partition have their un-notched edges slidable in opposed channels, and they are moved laterally in one direction to cause their notches to intersect. For an illustrated 12-cell partition formed of three double-notched strips and two triple-notched strips, intersecting is shown to be done by inserting the three tabs of each double-notched strip into first, second and third grooves in one fact of an elongated bar, and by inserting the notched edges of the two triple-notched strips into respective slots in the bar, wherein one slot is located between the first and second grooves and the other slot is located between the second and third grooves. Such triple-notched strips are moved at an angle with respect to the other strips, and drives for the sets of strips are synchronized to effect interleaving of the tabs and intersecting and interlocking of the sets of strips via their notches. Also disclosed are different arrangements for feeding the sets of strips from different sources from different directions, and different types of drives for conveying the sets of strips into intersecting relation. There is further disclosed automatic stacker mechanism for conveying completed partitions in overlapped relation to a gathering station, and moving groups of such overlapped partitions to effect their tying at a tie station, such movement in one arrangement employing articulating members for moving overlapped partitions to parallel position and thence to the tie station, and in other arrangement effecting movement of the partitions to the tie station in overlapped relation.

11 Claims, 15 Drawing Figures

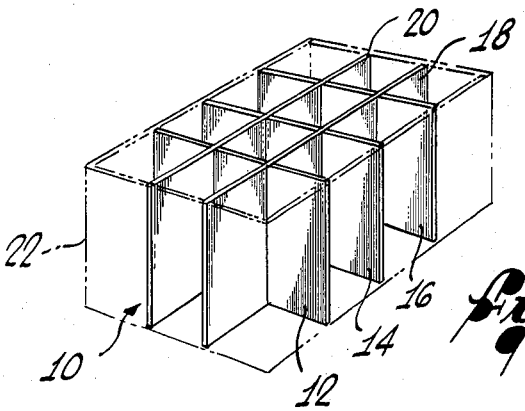
Fig. 2
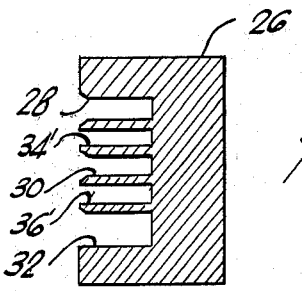
Fig. 4
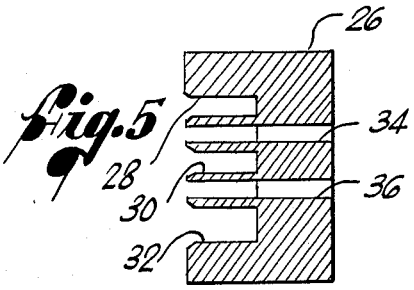
Fig. 5
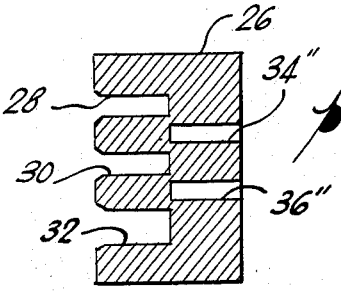
Fig. 6
Fig. 3
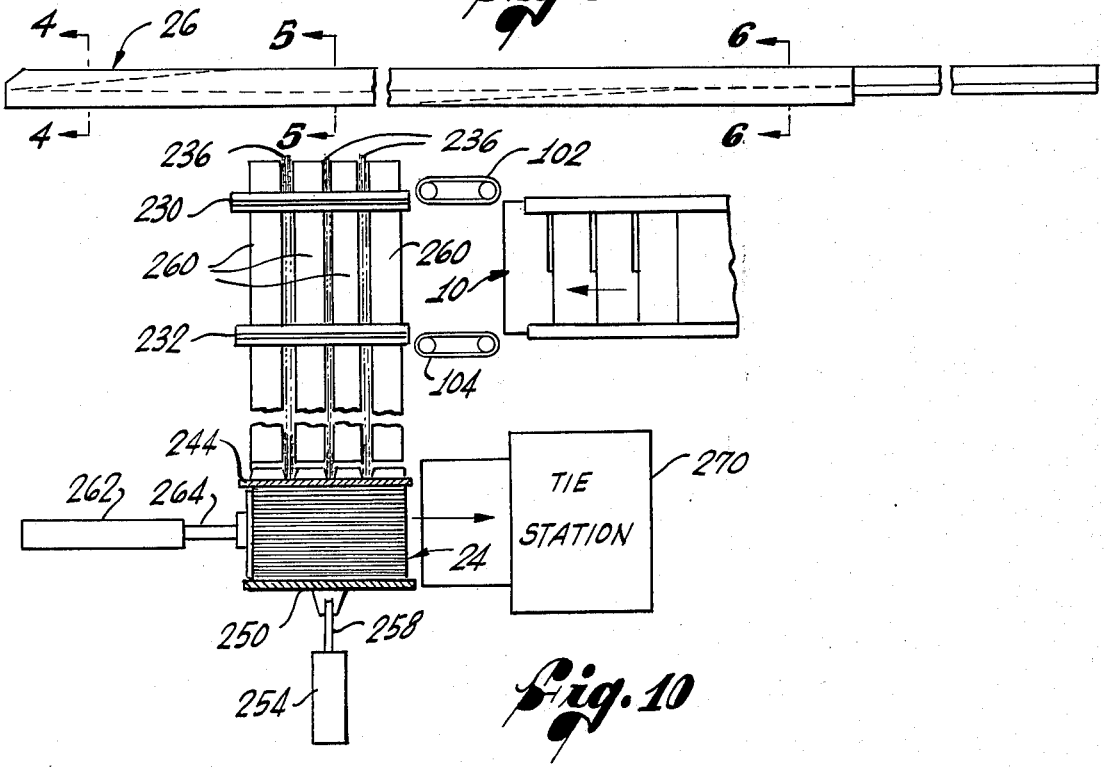
Fig. 10

HIGH SPEED PARTITION ASSEMBLING METHOD AND APPARATUS

BACKGROUND OF THE INVENTION

1. Field of the Invention

This invention relates to methods and apparatus for forming multi-cell partitions to be inserted in packing boxes.

2. Description of the Prior Art

As heretofore known, a multi-cell partition is formed by cutting and slotting two sets of strips to be interlocked by intersecting them at their notches. Each set has the strips thereof vertically oriented, and the sets are positioned so that the strips of one set are disposed above and at right angles to the strips of the other set, and with the notches in respective vertically spaced strips being aligned. Then the sets of strips are simultaneously moved together to effect intersecting at the aligned notches. Typically, one set of strips is moved onto a platform where the strips thereof are oriented with their uninterrupted edges setting on the platform. The strips of the other set are carried via conveyor means to a position above those resting on the platform, and then the upper set is moved downwardly to effecting intersecting, whereupon the mechanism holding the upper strips releases them and returns to permit another set to be moved into position. The completed partitions are removed from the platform and tied for shipment.

All attempts to speed partition formation have been severely hampered because of the numerous start-stop operations required, i.e., intermittently moving parts to receive strips and orient them vertically, move the strips in parallel relation to the assembly station, hold the strips momentarily stationary and poised with their notches aligned, then effecting vertically reciprocal movements to form the partition and return for repeat operation, and collapsing the formed partition for removal and tying. For example, successive strips may be fed into an assembler at the rate of 750-ft. per minute, but due to the various intermittent operations the assembler moves strips at a rate approximately only one-third of the input feed capacity.

SUMMARY OF THE INVENTION

This invention embraces method and apparatus for feeding sets of strips flat with tab edges of strips of two sets confronting but in different planes, and moving all strips laterally while decreasing the distance between their remote edges to progressively increase interleaving of tabs. Also embraced is method and apparatus for feeding strips to tab interleaving position from locations opposite, on the same side of, or at one end of such position. Further, this invention embraces automatic stacking method and apparatus for assembled partitions.

BRIEF DESCRIPTION OF THE DRAWINGS

FIGS. 1A and 1B together are a perspective view of a complete strip former, feeder and assembler in accordance with this invention, wherein FIG. 1A is a perspective of the assembler, and FIG. 1B is a perspective of the strip cutting, slotting, and feeder;

FIG. 2 is a perspective view of an assembled partition in a container;

FIG. 3 is a top plan view of the central bar of the invention for interleaving tabs of different sets of strips;

FIG. 4 is a sectional view taken along the line 4—4 of FIG. 3;

FIG. 5 is a sectional view taken along the line 5—5 of FIG. 3;

FIG. 6 is a sectional view taken along the line 6—6 of FIG. 3;

FIG. 9 is an end view of automatic stacker apparatus for assembled partitions in accordance with the invention;

FIG. 10 is a top plan view of the automatic stacker of FIG. 9;

DESCRIPTION OF ILLUSTRATIVE EMBODIMENTS

Figures 1A, 9:
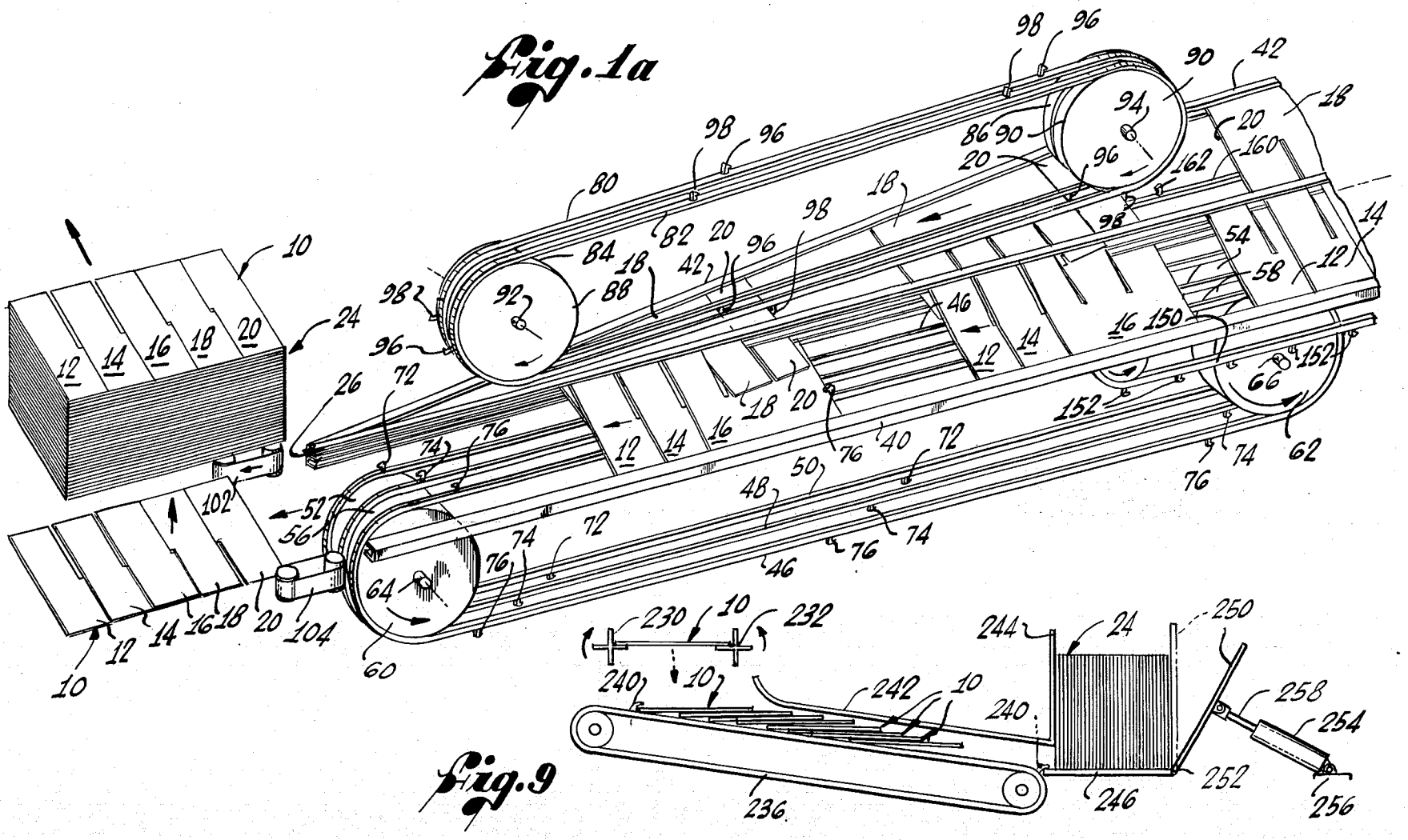
Figure 1B:
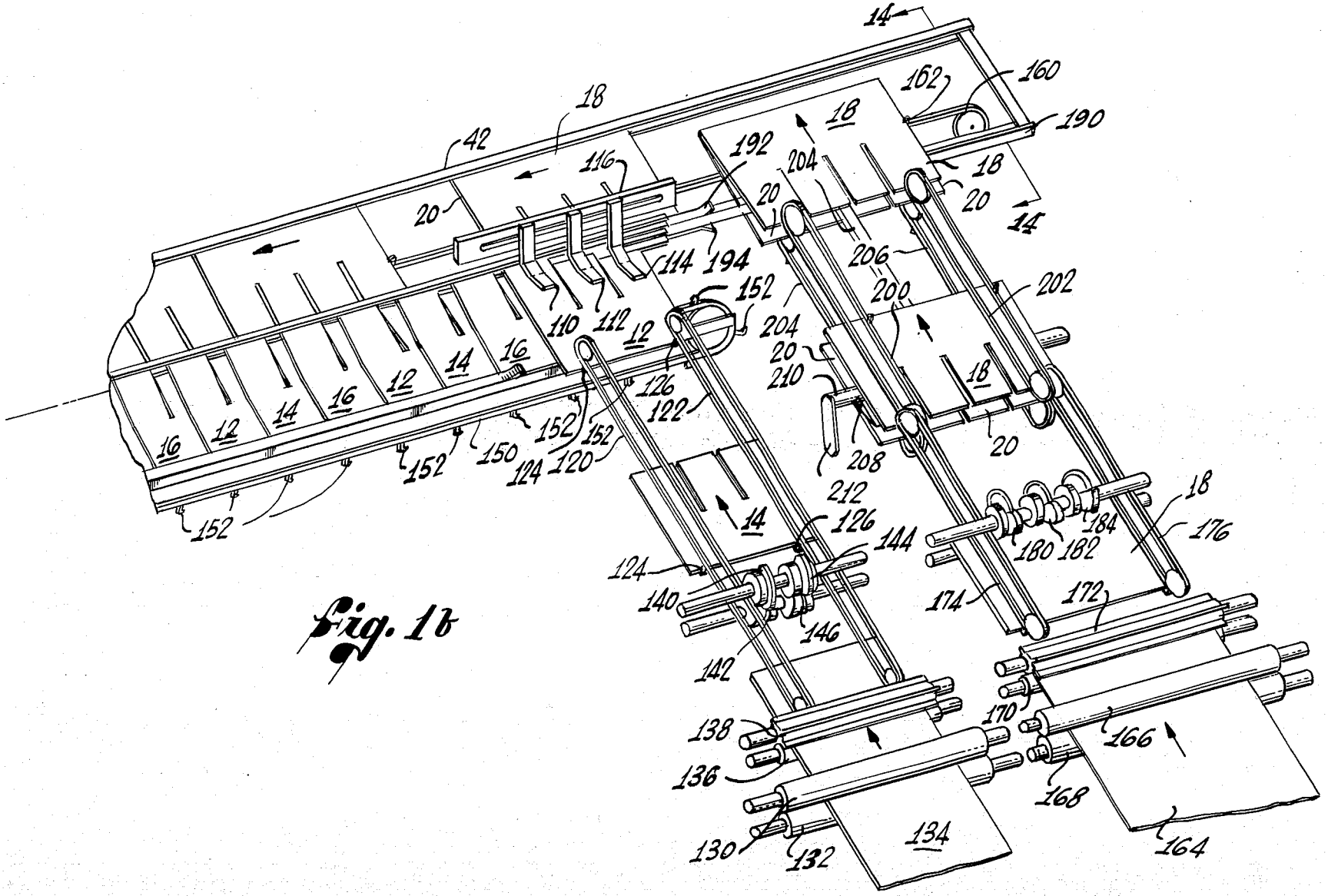

Referring to FIGS. 1A and 1B, there is shown a partition assembler in accordance with the invention for forming 12-cell partitions. FIG. 2 shows such a partition 10 formed of three double-slotted strips 12, 14, 16 and two triple-slotted strips 18, 20. In FIG. 2, the partition 10 is opened and inserted in a box 22 indicated in phantom.

At the left end in FIG. 1A, a collapsed partition 10 is shown leaving the assembler, from which a stack 24 of such collapsed partitions is formed to be tied and shipped. As previously explained, partition assemblers of the prior art as heretofore known are operative to form partitions in open condition as shown in FIG. 2, and then collapse them for removal and stacking. In accordance with this invention, however, all strips are maintained in flat stacked relation throughout, and are interlocked via unique strip mover and guide means operations which effectively interleave the tabs of the sets of strips 12, 14, 16 and 18, 20 in a manner analogous to shuffling them together.

In essence, this objective is achieved by supporting each double slotted strip with its three tabs extending into respective planes, with corresponding tabs of the three strips of that set being in the same plane; supporting the triple slotted strips so that all tabs of one are in a plane between those occupied by middle and one end tab of each double slotted strip, and all tabs of the other triple slotted strip are in a plane between the middle and remaining end tabs of each double slotted strip; and moving the sets of strips parallely and towards each other so as to interlock the tabs and complete the assembly of such partition.

In FIG. 1A, the means for effecting such tab separations and interleaving includes a tab-receiving guide bar 26. Referring to FIGS. 3–6 along with FIG. 1A, the bar 26 has three grooves 28, 30, 32 in its front face running the length thereof (see FIG. 4). Each of the double slotted strips 12, 14, 16 has its left tab inserted in the upper groove 28, its middle tab inserted in the middle groove 30, and its right tab inserted in the lower groove 32. In FIG. 3, the dotted line that is parallel to and near the front face of the bar 26 indicates the depth of the grooves. The guide bar 26 also has two through slots 34, 36 which at one end (the left end in FIG. 1A) terminate in grooves 34', 36' in the front face of the bar (see FIG. 5), and which at its other end (the right end in FIG. 1A and the left portion of FIG. 1B) terminate in grooves 34'', 36'' in the back face of the bar (see FIG. 6), such terminations preferably being gradually tapered as indicated at angled dotted lines in FIG. 3 showing such grooves. One of the triple slotted strips 18 has all its tabs inserted initially in one of the grooves 34'', 36'' in the back face of the bar 26, and the other such strip 20 has all its tabs inserted in the other of such grooves. Accordingly, movement of the sets of strips from right to left and towards each other in FIG. 1A is adapted to effect the positioning of respective tabs of the upper triple slotted strip 18 between overlapping upper and middle tabs of the strips 12, 14, 16, and the positioning of respective tabs of the other triple slotted strip 20 between overlapping middle and bottom tabs of the strips 12, 14, 16.

The interleaving and interlocking of the tabs of the strips of the two sets is facilitated by the use of outer channels 40, 42. One channel 40 is parallel to the bar 26, and the other channel 42 includes a right end portion parallel to the bar 26 and a left end portion that forms an acute angle with the bar. The unslotted edges of strips 12, 14, 16 ride in the channel 40, and those of the strips 18, 20 ride in the channel 42.

The sets of strips are moved along the channels 40, 42 and bar 26 via suitable drives. With reference to the strips 12, 14, 16, they are moved via belts or chains 46, 48, 50 carried on respective sprocket pairs 52–54, 56–58, 60–62 supported on shafts 64, 66. The belts 46, 48, 50 carry respective spaced fingers 72, 74, 76, such belts being initially adjusted so that the fingers 72, 74, 76 are spaced longitudinally a distance equal to the width of a tab of the strips. The drive is in a direction (counterclockwise in FIG. 1A) to move the double slotted strips 12, 14, 16 from right to left in the arrangement shown, in which the right or trailing edges of the strips are respectively engaged by fingers 72, 74, 76.

In like manner, the triple slotted strips 18, 20 are moved via belt or chain drives 80, 82 carried on respective sprocket pairs 84–86 and 88–90 supported on shafts 92, 94. The belts or chains 80, 82 carry respective spaced fingers 96, 98, as to which initial positioning of the belts is made so that respective finger pairs 96, 98 are longitudinally spaced the width of a tab of a strip. The drive is in a direction (clockwise in FIG. 1A) so that the right ends or edges of the strips 18, 20 are engaged and moved from right to left by respective fingers 96, 98.

The drive for the sets of partition strips are synchronized so that slots in the strips of one set intersect with slots in strips of the other set, as the strips 18, 20 begin movement towards the strips of the other set. Accordingly, as movement of such interleaved sets of strips proceeds from right to left, such intersecting increases progressively as the unslotted edges of the strips 18, 20 are moved progressively towards coplanar relation with the edges of the tabs of the set of strips 12, 14, 16.

In this latter regard, the channel 42, in which the unslotted edges of the strips 18, 20 ride, is seen to extend to the left end of the bar 26. When the fingers 96, 98 leave contact with the strips 18, 20, movement of the strips continues because of their intersecting and interlocking engagement with the strips of the other set 12, 14, 16 which continue movement to the left under the force of the fingers 72, 74, 76 on drive belts 46, 48, 50. Further, as the intersecting of the two sets of strips progresses, the unslotted edges of the strips 18, 20 are carried out of the channel 42 and pass through the slots 34, 36 to ride in the grooves 34', 36' in the front face of the bar 26. Correlatively, the ends of the tabs of the strips 18, 20 move into the channel 40 as the nesting or intersecting approaches completion.

As the partition 10 thus assembled extends at its left end beyond the left ends of the bar 26 and channel 40, opposite edges of the assembled partition are engaged and conveyed clear of the assembler for stacking, as by flat belt loops 102, 104 cooperably driven to effect continued right to left movement of such completed partitions.

Further in accordance with this invention, the sets of strips 12, 14, 16 are automatically fed so their tabs extend into the respective grooves 28, 30, 32 in the front face of the bar 26, and their unslotted edges move into the channel 40. Also, each set of strips 18, 20 is automatically fed so their unslotted edges extend into the channel 42 and their tab edges are moved into the grooves 34'', 36'' in the back face of the bar 26. As best seen in FIG. 1B, with respect to the double slotted strips 12, 14, 16, three spaced tab deflectors 110, 112, 114 are carried by a support 116 that is mounted atop the bar 26. The deflectors are generally V-shaped in the arrangement shown, with one straight leg being releasable secured adjacent its end to the support 116. The lowermost surfaces of the remaining legs of the deflectors, which extend outwardly and upwardly as shown, are coplanar with the respective grooves 28, 30, 32 in the front face of the bar 26. The deflectors curve outwardly and upwardly from such lowermost surfaces to extend through a plane in which partition strips are moved towards the bar 26.

In this latter regard, a strip 12 is shown being moved in such plane, thereby causing the tabs of such strip to engage the lower surfaces of the deflectors 110, 112, 114, whereupon further inward movement of the strip causes the ends of the tabs to be cammed by the deflectors so as to enter the grooves 28, 30, 32. Such movement is effected via belot or chain drives 120, 122 which carry fingers for engaging the unslotted edges of the strips and moving the strip towards such deflectors.

The conveyors or drives 120, 122 are adapted to receive the strips from a suitable source. For example, the strips may be cut and slotted and fed into place from a roll or web, or from a stack of sheets; or they may be pre-cut and slotted and fed from a stack of strips. In FIG. 1B, there is shown roller means 130, 132 for receiving and moving the end of a sheet or roll 134 from which the strips are to be cut and slotted, such end passing between a roller-cutter combination 136, 138, via which the cutter 138 cuts strips of predetermined length.

After being cut, strips are conveyed via the belts 120, 122 and fingers thereon to pass between two pairs of cooperative cutter elements 140, 142 and 144, 146 which slit or notch the strips to form the three tabs at the leading edges thereof. After thus being slotted, the strip is conveyed as previously described into engagement with the deflectors 110, 112, 114 so the tabs are cammed into the grooves 28, 30, 32 in the front face of the bar 26. The strips thus conveyed are of course suitably supported, as by riding on the upper surfaces of rails (not shown) which parallel the chains or belts 120, 122.

To facilitate movement of the trailing edges of the strips 12, 14, 16 into the channel 40 during right to left travel, the top wall of the channel 40 is removed at the portion thereof that spans the width of the strips that pass over it and into engagement with the tab deflectors 110, 112, 114. The fingers on the belts 120, 122 remain in engagement with the trailing edge of a strip until such edges passes over the web of the channel 40 and can move downwardly to ride on the bottom wall of the channel.

Immediately upon a strip being positioned as described wherein its tabs are deflected into the grooves in the front face of the bar 26, the strip is engaged and moved from right to left. For this purpose, suitable drive means is shown at 150 as a belt or chain carrying spaced fingers 152. The fingers 152 preferably are spaced apart a distance somewhat greater than the width of a tab of a strip. The belt or chain 150 is supported on suitable sprockets and is sufficiently long to permit the finger 152 engaging a strip to remain in contact with such strip beyond the point at which the strip is engaged by a finger on one of the belts or chains 46, 48, 50. The overlap distance is selected to insure that no strip is released before it is engaged by a finger on a respective drive, whereby proper timing of the movements of the strips of a set is maintained for the desired intersecting and interlocking actions previously described.

As previously indicated, the strips 18, 20 of each pair of triple slotted strips are moved in unison towards their assembler drive belts 80, 82. For this purpose, there is provided a pickup belt or chain drive 160 with spaced fingers 162 for engaging the right ends of both strips 18, 20 of each pair and moving them from right to left. The belt or chain is sufficiently long to insure that the finger 162 engaging a pair of strips remains in contact with them beyond the point of their engagement by respective fingers 96, 98 on the drive belts 80, 82.

The strips 18, 20 are obtained from a suitable source as with the strips 12, 14, 16 previously described. In the illustrated example, the end of a sheet or roll 164 of the needed width passes between roll feed means 166, 168 and cutter means 170, 172, which function as the roll feed means 130, 132 and cutter means 136, 138 above described for the double slotted strips. As each strip is cut from the source 164, it is fed through slot cutting means wherein cutter elements 180, 182, 184 are adapted to cut three slots of the required length. However, the slots formed in the strips 18, 20 begin in the body of the strips and extend through the trailing edges thereof. Cooperative grooved rollers for the cutter elements are not shown, but will be understood to correspond to the elements 142, 144 which cooperate with the cutters 140, 144 for the double slotted strips.

Successive triple slotted strips are directed so their slotted trailing edges are aligned to pass into the grooves 34'', 36'' in the right end of the bar 26. To this end, a bar 190 is secured to the right end of the bar 26, and has upper and lower horizontal surfaces which are in the planes of the lower and upper surfces, respectively, of surfaces, grooves 34'', 36'' in the back face of the bar 26. The bar 190 preferably has lips above and below its upper and lower surfaces, e.g., as a T-bar. Also extending from the right end of the guide bar 26 may be deflectors 192, 194 wherein the lower surface of the upper deflector 192 is coplanar with the upper wall of the groove 34'' and the uppermost surface of the lower deflector 194 is coplanar with the lower surface of the groove 36''.

Of each pair of triple slotted strips 18, 20, one strip 18 is fed across the top of the bar 190 and the other strip 20 is fed across the bottom of the bar 190. The strips are thus fed until the unslotted leading edges thereof are inserted in the channel 42 and their slotted trailing edges are past the lips of the bar and register against its upper and lower surfaces. When a pair of such strips is thus positioned, the next succeeding finger 162 on the belt 160 engages and moves both strips simultaneously to the left. The deflectors 192, 194 cooperatively aid in insuring the passage of the slotted edges of the respective strips 18, 20 into the grooves 34'', 36'' in the bar 26.

In the arrangement shown, successive strips 18, 20 are directed along the upper and lower portions of the bar 190 by effectively deflecting them to respective conveyors. To this end, there are shown upper and lower belts or chains in pairs 200, 202 and 204, 206. Adjacent the forward ends of such conveyors is a deflector element 208 that is carried on a shaft 210 adapted to be angularly articulated between two positions, as indicated by arrows for movement of a crank arm 212 attached to the shaft 210. With the shaft in one position, the deflector 208 causes one strip 18 to be carried by the upper conveyors 200, 202 so as to pass over the upper surface of the bar 190. In the other position of the shaft, the deflector 208 causes the other strip 20 to be carried by the lower conveyors 204, 206 so as to pass to the lower surface of the bar 190. Such conveyors carry fingers that are adapted to engage the tab edges of the strips until the unslotted edges thereof enter the channel 42 and the tab edges clear the lips of the bar 190.

Articulation of the deflector 208 may be effected by any suitable means. Thus, the arm in one arrangement is spring biased to one of its two positions, and a cam (not shown) engages the arm 212 and is rotated against the arm to overcome the bias and move the arm to its other position.

As will be apparent, the upper strip 18 is deflected to the bottom portion of the top conveyors 200, 202 to be engaged by fingers thereon, and the lower strip 20 is deflected to the top of the lower conveyors 204, 206 to be engaged by fingers thereon. To insure that the strips 18, 20 are carried in the proper planes, nails (not shown) are provided which extend from the bar 190 and have upper and lower surfaces coplanar with the edges of the lips of the bar 190. Desirably, such rails are located on each side of the conveyor chains 200, 204 and 202, 206. Thus, the upper strip 18 is moved along the uppers surfaces of such support rails by the fingers on the upper conveyors 200, 202, and the lower strip 20 is carried on the lower conveyors 204, 206 and moved along the lower surfaces of such support rails.

Figure 14:
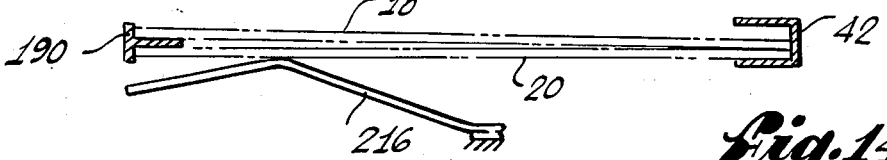
FIG. 14 is a fragmentary sectional view taken along the line 14—14 of FIG. 1.

FIG. 14 illustrates means for supporting the lower strips 20 while the strips 18, 20 are moved laterally via belt 160 so their tab edges enter the grooves 34'', 36'' in the back face of the guide bar 26. A deflector 216, which preferably is spring-like, is positioned to be engaged by the leading edge of a strip 20 as it passes the bar 190, and to cause such leading edge to be directed into the channel 42 and the tab edge to be urged against the lower surface of the bar 190. The lower strip thus guided is also effective to aid passage of the upper strip 18 so that its unslotted edge enters the channel 42 and its tab edge rests against the upper surface of the bar 190.

Figure 13:
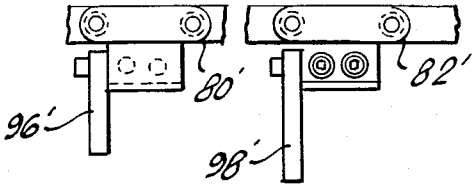
FIG. 13 is a fragmentary side elevation view of assembler chains and fingers thereon for strips of the other set taken of the region delineated at 13 in FIG. 11.
Figure 12:
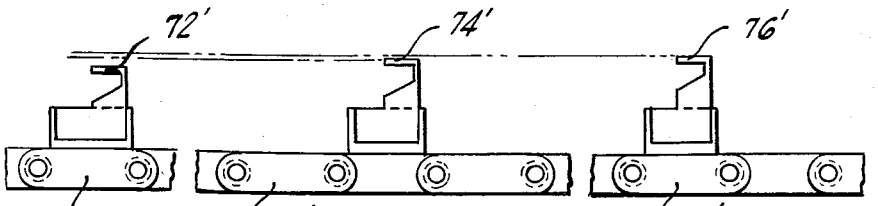
FIG. 12 is a fragmentary side elevation view of assembler chains and fingers thereon for strips of one set taken of the region 12—12 in FIG. 11.
Figure 11:
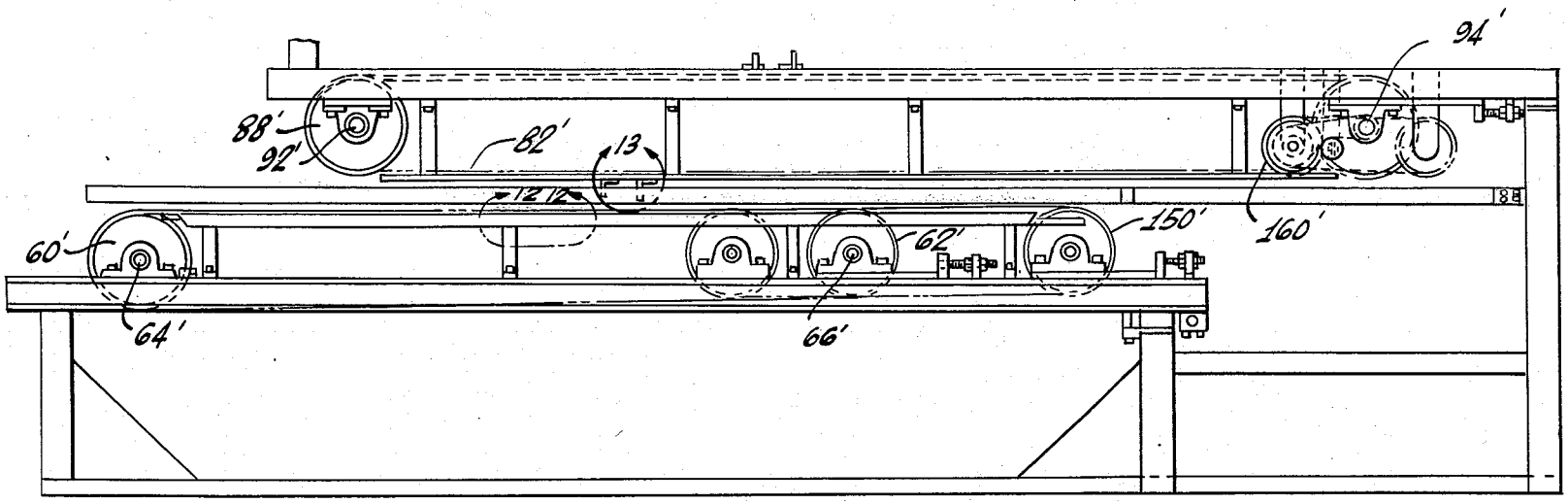
FIG. 11 is a front elevation view of an assembler of the invention wherein assembler chain movers for one set of strips engage the strips well ahead of the interleaving position.

FIGS. 11–13 illustrate assembler apparatus of the invention wherein prime numbers are used for parts that correspond to parts previously described. Modifications shown include drives for right to left movement of the triple slotted strips 18, 20 in which both pickup and assembler chains 160′, 80′, 82′ are all mounted above planes of movement of the strips. Also, the pickup chain 160′ is relatively short, so that substantially immediately after fingers on the chain 160′ engage the strips 18, 20, the right edges thereof pass to a position where fingers 96′, 98′ on the relatively long loop chains 80′, 82′ engage the right ends of the respective strips 18, 20 and keep them moving with a one tab spacing as described for the embodiment shown in FIGS. 1–6.

As in the embodiment shown in FIGS. 1–6, the various chains 150′ and 46′, 48′, 50′ are located below the planes of movement of the strips 12, 14, 16 moved thereby. However, the chains 46′, 48′, 50′ are illustrated with fingers 76′, 78′, 80′ vertically spaced. The spacing is preferably the thickness of a strip. Thus, the lowermost finger 76′ extends over the top surface of the lowermost or first strip 12 at its right end; the next finger 78′ similarly engages the right end of the next strip 14; and the third finger 80′ similarly engages the right end of the third strip 16. Additionally, by effecting movement of the chains 46′, 48′, 50′ at a very slight angle downwardly from right to left, the fingers 76′, 78′, 80′ cause the mid-portions of the strips 12, 14, 16 to bow downwardly a slight amount, and such action aids the interleaving and intersecting of the sets of strips to complete a partition.

In a partition assembler as above described, partitions are formed in substantially greater numbers that can be realized with assemblers heretofore known. With a continuous operation the assembler of this invention is operable to feed material from the rolls 134, 164 at rates up to a thousand feet per minute, and to form up to four hundred completed partitions per minute therefrom. This contrasts sharply with the better assemblers heretofore known, with which a single machine uses parallel setups to produce partitions, yet does not produce more than one hundred fifty per minute on a sustained basis.

As previously indicated, assemblers heretofore known form partitions in open condition, then collapse them for removal and stacking. Typically, collapsing and stacking are done by hand. There is no known stacking mechanism for accommodating completed partitions as formed in the volume permitted by an assembler in accordance with this invention. Further in accordance with this invention, and referring to FIGS. 9 and 10 together with FIG. 1A, successive completed partitions are moved via the belts 102, 104 onto horizontal fins of elongated rotors 230, 232 which are adapted for contra-rotation as indicated.

In the arrangement shown, the rotors 230, 232 turn so as to permit the partitions to drip onto conveyor means, here illustrated as chains 236 carrying spaced fingers 240 (FIG. 9) and located between broad belts 260. The completed partitions travel beneath a plate 242 which terminates in a vertical plate 244, and the fingers 240 cause the partitions to move over a horizontal plate 246 towards an upwardly inclined plate 250. In the illustrated arrangement, the plate 250 is hinged at 252 for angular movement relative to the plate 246. Such articulation of the plate 250 is effected via a cylinder 254 which is supported at 256 for limited angular movement, and which has a piston rod extension 258 connected to the plate 250.

Periodically, the cylinder is operated to raise the plate 250 to the vertical position. This action occurs when there is a sufficient number of completed partitions to be tied, i.e., when the fingers 240 reach the notches in the plate 246, at which time the completed partitions forward of the fingers have been oriented upwardly be virtue of the engagement of the forward edge of the first partition with the plate 250 while in its upwardly inclined position. Thus, the partitions moving down the belts 260 are overlapped as illustrated in FIG. 9, and upon the fingers 240 reaching the plate 246 the partitions are substantially parallel with the inclined plate 250.

Movement of the plate 250 to the vertical causes the partitions to be moved to the vertical. Referring to FIG. 10, cylinder 262 is operable via its piston rod 264 and a plate thereon to move the stack 24 of completed partitions from between the plates 244, 250 to a tie station 270. Operation of the cylinder 262 occurs upon the plate 250 reaching the vertical position.

Synchronizing operations of the movable elements of the automatic stacker is effected in any suitable manner, the details as to which are omitted for the sake of clarity in the drawings and because the same will be apparent to one skilled in such art. The rotors 230, 232 are adapted for predetermined rotary movement, e.g., 90°, upon completion of each partition so the partition previously supported on the rotor fins is dropped to the conveyor, and the next completed partition passes onto the rotor fins. Operation of the cylinder 254 is effected upon each chain finger 240 reaching the horizontal plate 246, by the finger tripping a switch (not shown) in a control circuit for the cylinder. Similar operation of the cylinder 262 takes place upon the plate 250 reaching the vertical, the plate 250 actuating a switch (not shown) in the control circuit therefor. The tying machine may be a conventional one adapted to effect tie packaging of collapsed partitions.

The invention embraces the use of other stacking means with the assembler apparatus. The plate 250 may be kept stationary in the inclined position, and the stack moved to the tie station along a fixed plate that makes a transition from inclined to vertical, as disclosed in copending application filed concurrently herewith entitled, "High Speed Automatic Stacker for Partitions and the Like." Also, stack movement may be effected horizontally as well as along an incline, and via linear actuator means as well as by cylinders, also as disclosed in said copending application.

Figure 7:
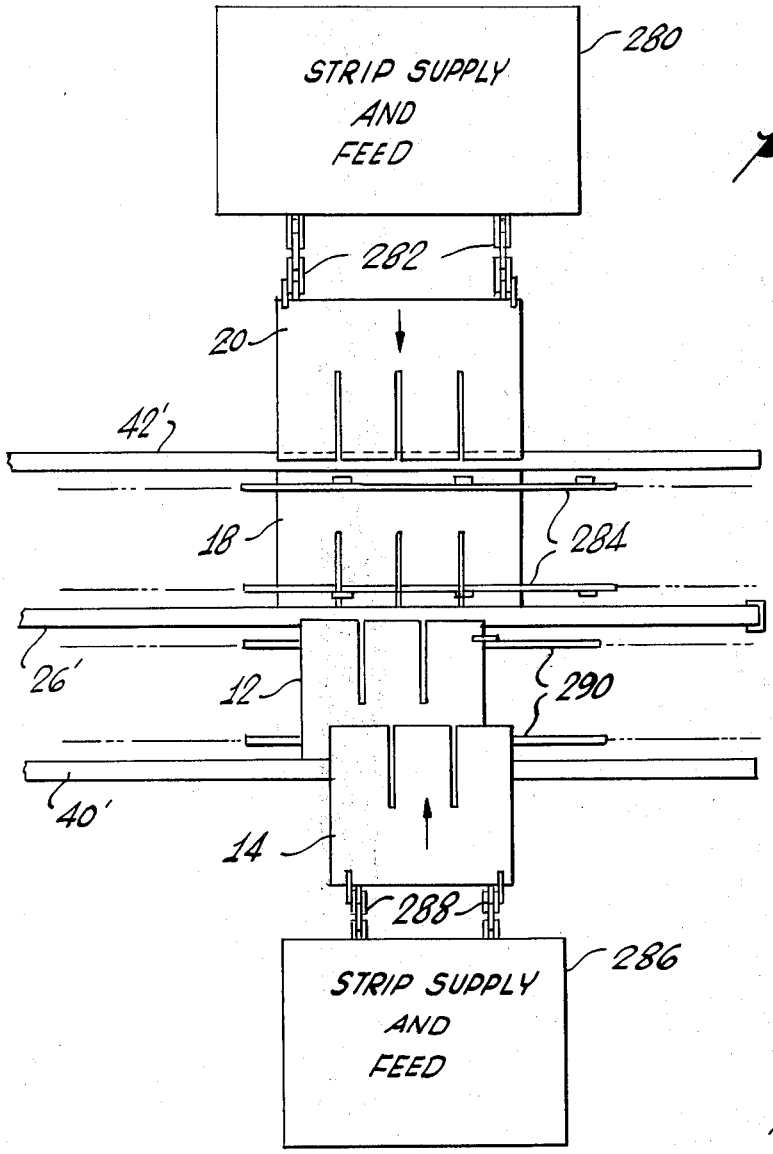
FIG. 7 is a schematic illustration of a strip feed apparatus of the invention wherein strips are fed to the center bar from opposite sides of the bar.
Figure 8:
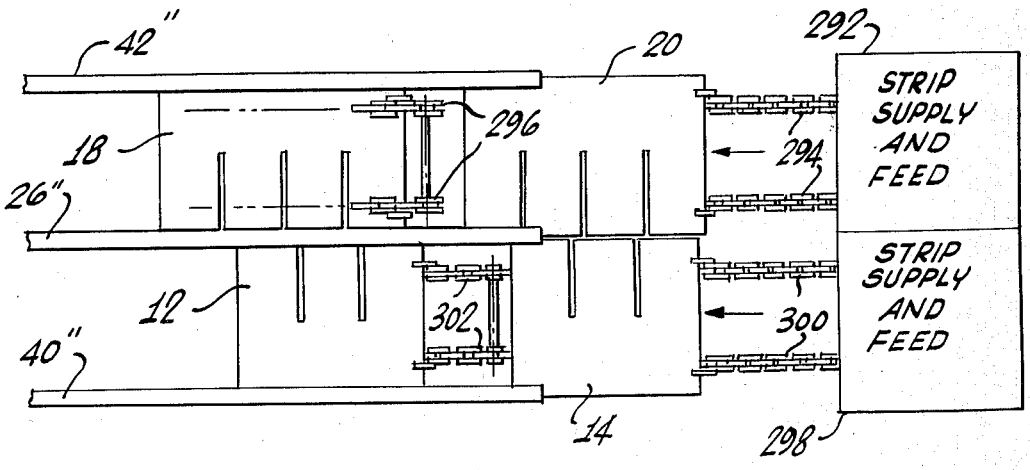
FIG. 8 is a schematic illustration of a strip feed apparatus of the invention wherein strips fed to the center bar are directed from one end thereof.

FIGS. 7 and 8 illustrate other arrangements for feeding strips into position which are embraced by this invention. In FIG. 7, sources of strip material and feed mechanisms for conveying the strips to position for assembly as a collapsed partition are illustrated at 280, 282, 284 and 286, 288, 290. In this case, the mechanism for directing the strips 18, 20 into the appropriate grooves in the back face of the guide bar 26′ may be the same as previously described, but placed on the opposite side of the bar from the position shown in FIG. 1B. Preferably the channel 42′ has its top wall cut away or otherwise suitably shaped to permit the trailing unslotted edges of the strips 18, 20 to pass the web of the channel and fall to the lower wall thereof.

In FIG. 8, the strip supply and feed mechanisms are shown an 292, 294, 296 and 298, 300, 302 in positions in line with the guide bar 26″ and channels 40″, 42″. Thus, this invention embraces the assembler together with any arrangement for feeding strips thereto.

Also, the assembler guide bar may be replaced with other means for effecting the interleaving and intersecting of the strips while forming a completed collapsed partition. For example a tier of three channels provides the structure for effecting such results, e.g., the channel openings correspond to the three grooves running the length of the bar previously described for FIGS. 1A, 3–8, and the slots are constituted of the spaces between the confronting walls of the upper and middle channels and the middle and bottom channels. If desired, tapered flat bars are secured in the end portions of the inter-channel spaces near their ends to provide means whereby the slots merge into grooves in the front and back end portions of the tier, i.e., bars tapered per the dotted lines indicated in FIG. 3. Alternatively, such bars could be eliminated and the channel tier placed under tension, in which case the closing movement of the triple slotted strips relies on the angled channel and intersecting double slotted strips to complete the nesting wherein the unslotted edges of the triple slotted strips are coplanar with the tab ends of the double slotted strips.

I claim:

1. Apparatus for assembling a collapsed partition from two sets of strips wherein each strip has spaced slots in one edge to provide a number of tabs, said apparatus comprising:

an elongated tab guide member having a number of parallel grooves in one face extending the length thereof, the grooves being equal in number to the number of tabs of a strip of one set, said guide member having elongated parallel slots extending through said one face to the opposite face thereof, said slots being equal in number to the number of strips in the other set, each slot being between and parallel to adjacent ones of said grooves;

means to position each strip of the one set adjacent said one face of said guide member with the ends of the tabs extending into the respective grooves;

means to position each strip of the other set adjacent said opposite face of said guide member with the ends of all tabs thereof extending into a respective slot;

respective means for engaging each strip at one end for movement towards the remote end of said guide member, said engaging means being operable to effect movement of the strips so the strips of each set are overlapped all but one tab width, said engaging means also effecting movement of said strips so that each slot of each strip of one set is aligned with a respective slot of a strip of the other set;

and means operable during said movement of said strips to force the strips of said other set through said guide member slots to effect intersecting of both sets via their aligned slots.

2. Apparatus in accordance with claim 1, wherein said guide member is a bar having the grooves in one face, and wherein the guide member slots extend through said bar and terminate at distances spaced from the ends thereof.

3. Apparatus in accordance with claim 1, wherein said guide member comprises a tier of parallel channel members, the channel openings of said members constituting said grooves, and the walls of each slot being constituted of the confronting walls of adjacent channel members.

4. Apparatus in accordance with claim 1, including means to convey the strips of said one set in succession to said one face at one end of said guide member, said positioning means for the tabs of the strips of said one set including deflecting means at said one face engageable by the respective tabs and operable to direct them into the respective grooves.

5. Apparatus in accordance with claim 4, including means to convey the strips of said other set to said opposite face of said guide member, said positioning means for the strips of said other set including deflecting means at said opposite face engageable by the strips and operable to direct their tab edges into the respective slots.

6. Apparatus in accordance with claim 5, including respective means engaging each strip of said one set promptly upon insertion of its tabs in said grooves and moving it towards the remote end of said guide member, said engaging means moving the strips of said one set in overlapped relation wherein each strip overlaps the preceding strip a predetermined amount less than one tab width, and maintaining engagement until after the strips are engaged by the respective engaging means for moving them in the overlapped condition wherein the overlap is the greater one-tab amount.

7. Apparatus in accordance with claim 6, including means engaging all strips of the other set upon their being positioned adjacent the opposite face of said guide member and moving all of them together to the position to be engaged by the respective engaging means for moving the strips towards the remote end of said guide member.

8. Apparatus in accordance with claim 7, including channel members on opposite sides of said guide member with their channel openings facing said guide member, and respective means for inserting the edges of the strips opposite their slotted edges so that such unslotted edges of the strips of the one set are all inserted in the channel confronting said one face of the guide member and such unslotted edges of the strips of the other set are inserted in the other channel member confronting said opposite face of said guide member.

9. Apparatus in accordance with claim 5, wherein said conveying means are adapted to continuously move strips to the corresponding face of said guide member from a source of strips, and said strip engaging and moving means operate to continuously move strips in sets to the remote end of said guide member to effect intersecting of sets and form completed partitions and means at said remote end of said guide member for engaging and removing each completed partition therefrom, including conveyor means at opposite edges of the partitions to propel them away from said guide member; and automatic stacker means for receiving the ejected partitions and gathering and stacking them into groups for tying.

10. Apparatus in accordance with claim 9, wherein said stacker means includes partition intercept elements to momentarily support each partition in horizontal position, and to drop such partition vertically;

conveyor means below said intercept elements for moving said partitions;

gathering means in the path of said conveyor means;

pusher means associated with said conveyor means for moving said partitions in groups to said gathering means;

means at said gathering means for positioning each group of partitions into a vertical stack;

and means for moving each vertical stack to a tie station for tying the partitions of such stack together.

11. The method of forming container partitions in collapsed condition comprising the steps of:

providing first and second sets of stacked parallel strips wherein each strip has slots in one edge to provide a number of tabs;

positioning the sets of strips with their tabbed edges confronting each other;

manipulating the tabs of the strips of first set so that the tabs of each strip extend into a respective plane;

positioning the strips of said second set in different planes with all tabs of each strip of said second set extending into the same plane, and wherein each of such different planes is between adjacent ones of the respective planes in which the tabs of the strips of said first set extend;

individually moving the strips of said first and second sets in a direction at right angles to the slots therein, with the strips of the respective sets overlapped so that each strip trails the preceding one by one tab width, and with each slot in each strip of one set aligned with a respective slot in a strip of the other set;

and directing one of said sets of strips at an angle with respect to the other set during their said movements to cause the tabs of both sets to progressively overlap and intersect until the end edges of the tabs of each set are coplanar with the unslotted edges of the strips of the other set.

* * * * *